United States Patent [19]

Dean

[11] Patent Number: 4,626,974

[45] Date of Patent: Dec. 2, 1986

[54] POST TOP LUMINAIRE CLAMP

[75] Inventor: John R. Dean, Memphis, Tenn.

[73] Assignee: FL Industries, Inc., Livingston, N.J.

[21] Appl. No.: 808,455

[22] Filed: Dec. 12, 1985

[51] Int. Cl.[4] ..... F21V 21/08

[52] U.S. Cl. ..... 362/396; 362/431; 248/219.2

[58] Field of Search ..... 362/396, 414, 431, 191, 362/368; 248/218.4, 219.2, 229, 230; 403/361, 373, 362, 366

[56] References Cited

U.S. PATENT DOCUMENTS 3,679,891 7/1972 Quack ..... 362/431

3,696,242 10/1972 Patry ..... 403/362

3,794,826 2/1974 Jablonski ..... 362/396

*Primary Examiner*—William A. Cuchlinski, Jr.

*Assistant Examiner*—D. M. Cox

*Attorney, Agent, or Firm*—Elliot M. Olstein

[57] ABSTRACT

A clamp for securing a pole top luminaire to the top of a support post. A fitter clamp is disposed inside of the support post, while the housing of the luminaire includes a base portion which extends from the luminaire downward surrounding the outer circumference of the support post. Threaded fasteners extend through the housing base portion to engage the fitter clamp, causing the clamp to expand and compressively engage the support post between the fitter clamp and the luminaire housing base portion.

3 Claims, 3 Drawing Figures

POST TOP LUMINAIRE CLAMP

BACKGROUND OF THE INVENTION

1. Field of the Invention

The present invention relates to a clamp for securing a post top luminaire to its supporting post. More particularly, the present invention provides a means for securing the post top luminaire to its post through the application of compression rather than tension forces applied to the base of the luminaire which fits over the post.

2. Brief Description of the Background Art

Clamp means employed previously to secure post top luminaires to the corresponding post are generally of two types. Exterior set screws are most commonly used, and for years provided an acceptable means for securing the luminaire to the top of the post due to the metal used in construction of these devices. The metal could easily withstand the tension forces asserted by such set screws, and thus apply the adequate clamping force. However, in recent years the use of metal bases for luminaires has been replaced by the use of less expensive, lightweight plastics in construction of the housing of the post top luminaires. While the advantages of plastic materials are numerous, the use of common exterior set screws with this new material to provide clamping to the post has been most unsatisfactory. The force exerted on the material when using set screws is concentrated in the area immediately surrounding the screw. Additionally, the tension forces exerted on the material while tightening the set screws can cause less expensive plastic material to expand away from the post, and even to break apart while securing the luminaire. For obvious reasons, neither expansion of the base material, nor breaking of the material, provide adequate clamping.

To overcome these difficulties, the use of separate exterior clamp elements to secure the illuminare has increased. However, the use of exterior clamps considerably depreciates the esthetic value of the luminaire. Additionally, while an interior bicycle handle bar type clamp has been used, such a device affords a solution that is too complex in both use and manufacture to be an efficient solution to the problem.

SUMMARY OF THE INVENTION

Therefore, it is an object of the present invention to provide an improved means for securing a luminaire to the top of a post while eliminating the tension exerted on the luminaire housing material.

Another object of the present invention is to provide an improved means for securing a luminaire having a plastic base to the top of a post wherein the plastic material forming said base is subject to compressive forces, rather than tension forces, when the luminaire is clamped to the post.

A further object of the present invention is to provide an improved means for securing a luminaire to the top of a tubular post which includes a fitter clamp element extending inside the top of the post, and screws which draw the fitter clamp element towards the base of the luminaire, and clamp the post compressively between the fitter clamp and the base of the luminaire.

Yet another object of the present invention is to provide an improved means for securing a luminaire to a post utilizing a clamping configuration which is simple, inexpensive, and functional.

DETAILED DESCRIPTION OF THE INVENTION

Figure 1:
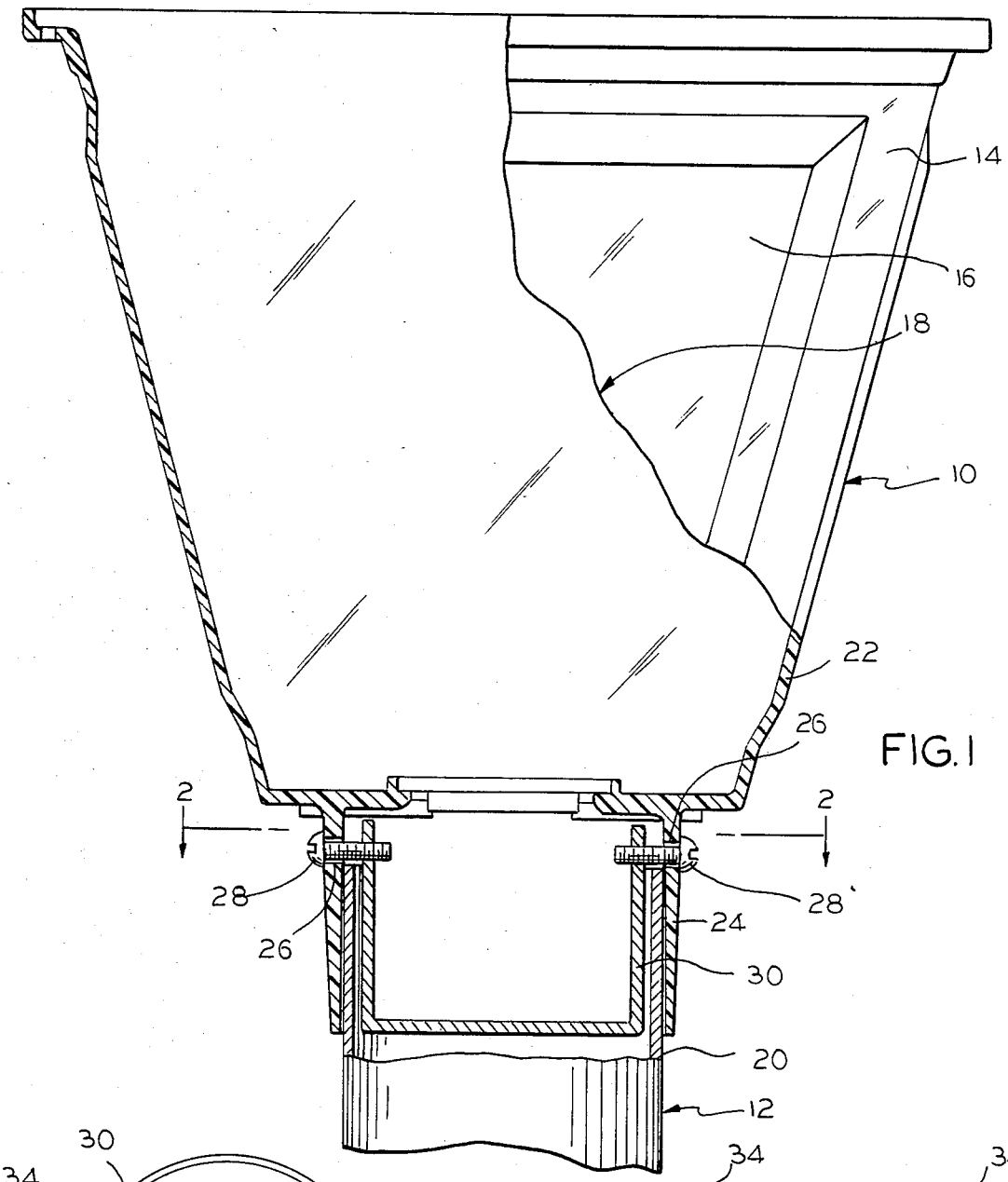
FIG. 1 is partially cut-away illustration of a luminaire secured to a hollow post utilizing the unique clamping structure of the present invention.

Referring to FIG. 1, the post top luminaire or lamp 10 rests upon tubular luminaire support post 12. The post top luminaire 10 of the illustrated embodiment includes a plastic housing 14 which comprises a transparent panes 16 to expose the light source contained inside the housing 14.

Both the post top luminaire 10 and the luminaire support post 12 are cut away in FIG. 1 to expose the features of the present invention.

Located at the bottom of the plastic housing 14 of the post top luminaire 10 is a tubular base portion 24, shown as circular in the preferred embodiment, and which extends around the top and outside of luminaire support post 12. Tubular base portion 24 includes apertures 26 located 180 degrees apart on the circumference of base portion 24 through which threaded fastening means 28 extends. The apertures 26 are of a comparatively larger diameter than the fastening means 28 and are unthreaded, thereby allowing free passage of the fastening means 28 through apertures 26.

Figure 3:
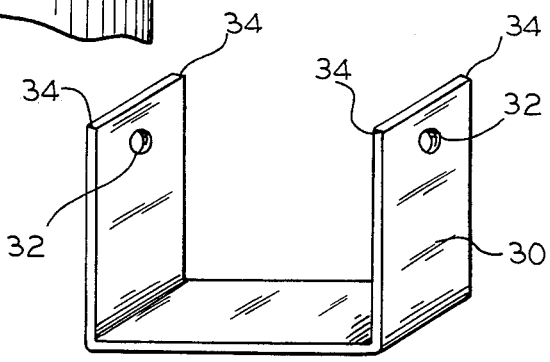
FIG. 3 is a detailed perspective view of the fitter clamp element forming part of the preferred embodiment of the present invention.

Each fastening means 28 engages a generally U-shaped fitter clamp 30, which is seen in detail in FIG. 3, and is positioned within the hollow upper portion of luminaire support post 12. Fitter clamp 30 includes apertures 32 which are aligned in concert with apertures 26 of base portion 24 to recieve the fastening elements 28. Fitter clamp apertures 32 are threaded to accept fastening elements 28. In the preferred embodiment, fitter clamp 30 is made of an inexpensive steel material, but could also be made of any other suitable material.

Figure 2:
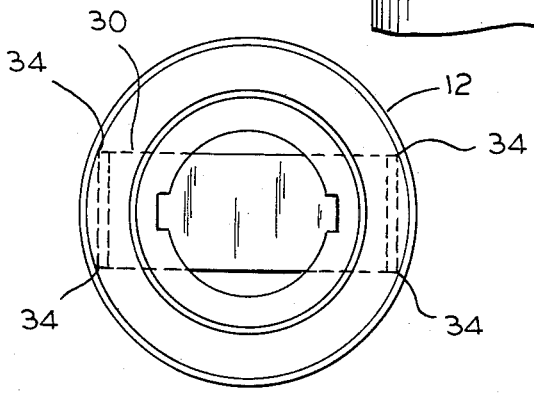
FIG. 2 is a top plan view of the clamping structure of the present invention, with the luminaire removed, and taken along line 2—2 of FIG. 1.

Upon attaching luminaire 10 to post 12, fitter clamp 30 is initially loosely attached to base portion 24 by fastening means 28 extending through apertures 26 and threaded partway into threaded apertures 32. Fastening means 28 are rotated several turns to insure that fitter clamp 30 will not fall during assembly, while at the same time leaving a gap between the edges 34 of fitter clamp 30 (FIG. 2) which is slightly wider than the thickness of the tubular wall of post 12.

The assembly described hereinabove is lowered over the top of post 12, with the wall of post 12 extending between base portion 24 of luminaire 10 and fitter clamp 30. When the top edge of post 12 abuts fastening means 28, or before contact is made, each fastening means 28 are rotated, thus bringing contact edges 34 of fitter clamp 30 into engagement with the inner wall of post 12 (FIG. 2) as fitter clamp 30 is drawn outward and the undersides of the heads of fastening means 28 bear against the outer wall of base portion 24. Thus, the top of post 12 is now wedged between base portion 24 and fitter clamp 30, and luminaire 10 is rigidly secured to post 12.

From the foregoing description, it is apparent that means have been provided to attach a luminaire 10 to a post 12 without applying a tension force to the base portion 24 of the luminaire, and thus avoiding undesireable expansion and possible breaking of the base portion. The clamping structure of the present invention applies a compressive force to the base of the luminaire, thereby compressing the plastic material of base portion 24 and fitter clamp 30, instead of pulling out on the plastic which occurs when standard set screw assemblies are used to attach luminaires to posts.

Since certain changes may be made to the above identified teaching without departing from the spirit and scope of the invention, it is intended that all matter contained in the above description or shown in the accompanying drawings shall be interpreted as illustrative and not in a limited sense.

I claim:

1. A device for securing a luminaire to a tubular support post including:

a luminaire housing including a base portion having a slightly larger inner diameter relative to said support post, said base portion including first aperture means extending therethrough;

fitter clamp means of smaller width relative to the inner dimension of said support post and adapted to be disposed partially inside said support post;

said fitter clamp means including second aperture means extending therethrough;

fastening element means extending through said first aperture means and bearing on an outside surface of said base portion, said fastening element means extending through said second aperture means and forcefully engaging said fitter clamp means, whereby actuation of said fastening element means compresses said support post between said fitter clamp and said base portion of said luminaire when said base portion is placed over said support post, whereby said luminaire is rigidly attached to said support post.

2. The device of claim 1, wherein said fastening means are threaded, and said second aperture means include corresponding threads.

3. The device of claim 1 wherein said fitter clamp is U-shaped in configuration, and includes contact points at the ends thereof which are adapted to bear against said support post when said fastening means are actuated.

* * * * *